United States Patent [19]

Bechtel

[11] 4,248,052

[45] Feb. 3, 1981

[54] FLOW SENSOR AND DEFROST SYSTEM INCLUDING SAME

[75] Inventor: Jon H. Bechtel, Holland, Mich.

[73] Assignee: Robertshaw Controls Company, Richmond, Va.

[21] Appl. No.: 957,590

[22] Filed: Nov. 3, 1978

[51] Int. Cl.[3] ..... F25D 21/02; G08B 19/02

[52] U.S. Cl. ..... 62/140; 340/580

[58] Field of Search ..... 62/140; 55/270; 73/170 R, 37, 38; 340/580

[56] References Cited

U.S. PATENT DOCUMENTS

| | | | |
|---|---|---|---|
| 3,107,499 | 10/1963 | Jokela | 62/140 |
| 3,250,083 | 5/1966 | Orth | 62/140 |
| 3,374,643 | 3/1968 | Thorner | 62/140 |

*Primary Examiner*—William E. Wayner
*Assistant Examiner*—Harry Tanner
*Attorney, Agent, or Firm*—Harold W. Adams

[57] ABSTRACT

A sensor for detecting changes in the rate of flow of a gaseous stream by sensing changes of temperature up and down stream of a single heat source. The invention finds application as a frost sensor for use in a defrost system.

2 Claims, 1 Drawing Figure

FLOW SENSOR AND DEFROST SYSTEM INCLUDING SAME

BACKGROUND OF THE INVENTION

It is broadly known to employ an air stream from an evaporator fan and its associated pressure drop across an evaporator coil to detect frost build-up in a refrigerator. A disadvantage of this type of frost sensor is that the air pressure to be sensed is so small that large and therefore expensive pressure sensors are required. Further, conventional frost sensors of this type may tend to cause both premature initiation and re-initiation of the defrost cycle.

SUMMARY OF THE INVENTION

The invention is a frost sensor for use with a refrigeration unit including means for sensing the pressure drop in an air stream across an evaporator coil of the refrigeration unit. A restrictor, having a restriction therein, is adapted for mounting adjacent the evaporator coil in the air stream. The fan provides a vacuum source that is interconnected to the restrictor and an air pressure detector by means of a common passage. The detector senses changes in air pressure in the passage caused by frost build-up in the restriction and the resulting obstruction of air flow into the restrictor. Control means responsive to the air pressure detector are provided to start a defrost cycle when the sensed air pressure reaches a determined value. Wick means remove droplets of liquid captured in the restriction during the defrost cycle.

BRIEF DESCRIPTION OF THE INVENTION

Figure 1:
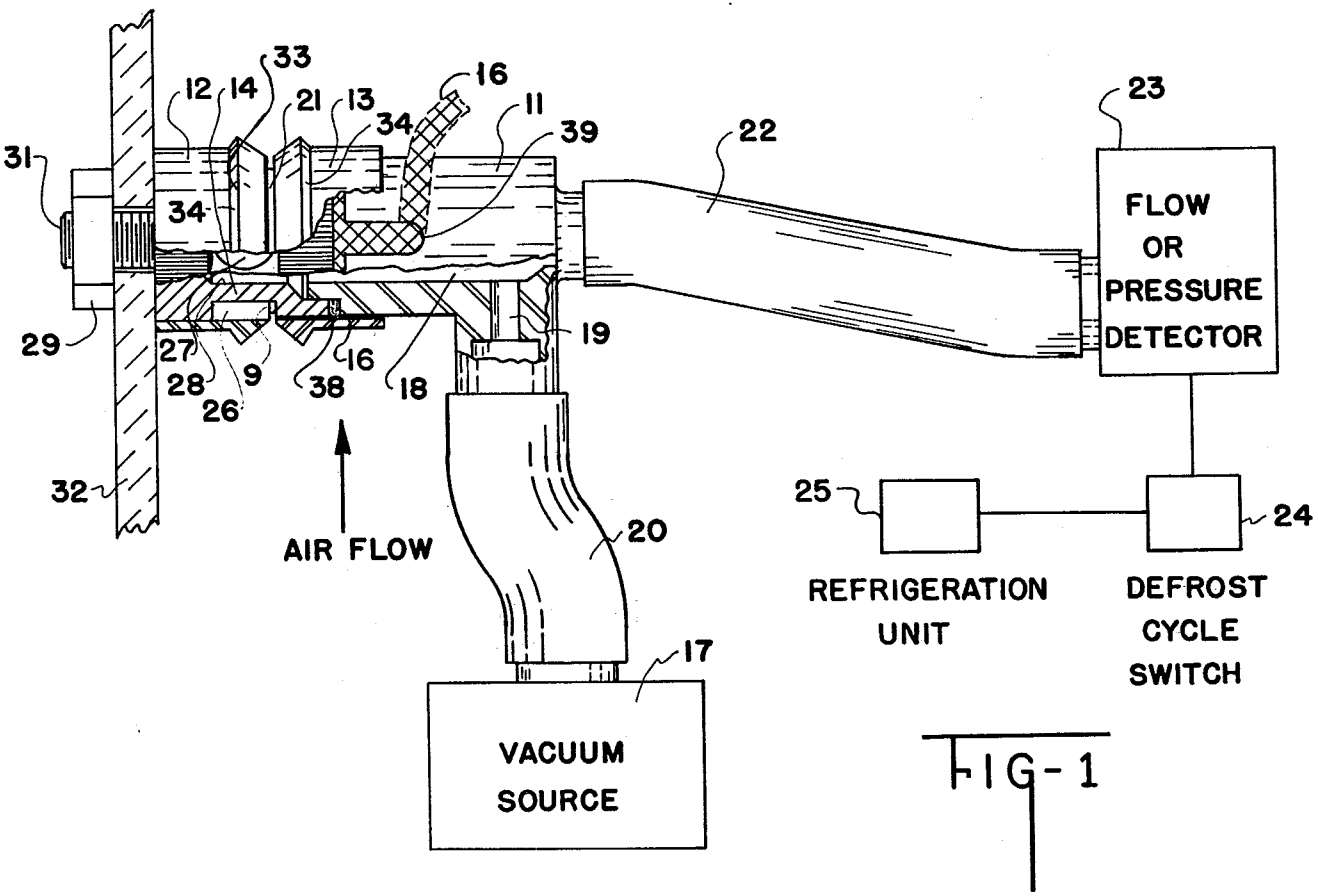
FIG. 1 is a side elevational, partially sectional and schematic illustration of a preferred embodiment in accordance with the principles of the invention.

As shown in FIG. 1 a preferred embodiment of the invention generally comprises a restrictor 11 formed of a cylindrical tube and including a pair of identical, outer, spaced, cylindrical aluminum rings 12 and 13 affixed to an inner fitting 14 that receives one end of the restrictor tube 11. A fiber glass wick 16 extends from and into the restrictor tube 11 where it engages the end face of fitting 14 for a purpose as will be described hereafter.

A vacuum source 17 draws air from manifold section 18 of the restrictor tube 11 through a flow restricting passage 19 and tube 20. Air is also drawn by the vacuum source 17 through an annular slot or restriction 21 between the spaced cylindrical rings 12 and 13 as will be described and through a pressure line 22 connected to both the manifold section 18 and a flow or pressure detector 23.

The vacuum source 17 may be provided by positioning the open mouth of tube 20 adjacent the tip of the evaporator fan blade. The high velocity at the periphery of the blade lowers the pressure in tube 20 drawing air through restriction 21 and tube 22. An electrical output of the detector 23 operates a relay switch 24 to turn off a refrigeration unit 25 and initiate a defrost cycle.

As can be seen pressure line 20 is common to both the restriction 21 and air pressure detector 23. Thus, the level of vacuum in the manifold 18, and lines 20 and 22 is substantially equal at all times. The defrost cycle switch 24 may also control a defrost heater near the evaporator coil.

As shown, annular slot or restriction 21 opens into a circular channel 26 formed in the end fitting 14, the external surface of which is fluted or toothed to permit a force fit of rings 12 and 13 thereon. A transverse hole 27 intersects a blind hole 28 formed along the longitudinal axis of end fitting 14 thus interconnecting the annular slot or restriction 21 and the manifold 18 in the plastic tube 11. A nut 29 threaded on stud 31 of end fitting 14 and which passes through a rib 32 of an evaporator unit thermally connects the frost sensing restrictor to evaporator member 32 of the refrigeration unit.

Moisture laden air, forced by an evaporator fan in the direction of the arrow, surrounds the frost sensor and is drawn by the vacuum source 17 through the restriction 21, the transverse hole 27, the blind hole 28 in the core 14, the manifold 18, and passage 19 into pressure line 20. As frost forms in restriction 21, the air flow through the annular restriction is obstructed increasing the vacuum level in manifold 18. This change is sensed by the detector 23 either as an increased vacuum level or as a decrease in air flow in line 22.

As can be seen, the threshold of frost detection may be adjusted by changing the vacuum provided at source 17, the diameter of manifold 18 in tube 11, the width of restriction 21, or the threshold level of detector 23.

Several features aid in clearing restriction 21 from defrost water during the defrost cycle. First, since the restrictor is mounted with its longitudinal axis on the horizontal, water will tend to run by reason of gravity to the lower edge or bottom of the circular groove forming the restriction 21 and then drop off. Second, if water droplets cling to the restriction 21 and cover it at or near the bottom, such a build-up of liquid can block but a small percentage of the entire periphery of the circular groove or restriction. In addition, ridges 33 formed by sloping surfaces 34 serve to channel away water that might otherwise run into the restriction 12 from the sides.

As noted the flutes on end fitting assist in obtaining a force fit of the rings 12 and 13 on the ends of core 12. This eliminates the need for close dimensional tolerances. In addition, the flutes under ring 13 provide a plurality of small capillary passages leading to wick 16 from restriction 21 when the ring 13 is pressed on to the end fitting.

The fiberglass wick 16 is pressed around and against the ends of these capillary passages at the end face of fitting 14. A tail of the wick 16 passes through groove 39 of tube 11 and may be placed close to a defrost heater or in any area where it will dry. In addition, any water that should remain in the restriction 21 after defrost is drawn into the capillary passages and absorbed by the wick.

While a preferred embodiment of the invention has been described in detail numerous changes and modifications can be made within the principles of the invention which is to be limited only by the scope of the appended claims.

What is claimed is:

1. In a frost sensor for a forced air refrigeration unit including means for creating an air stream adjacent an evaporator unit of said refrigeration unit the improvement comprising:

a cylindrical restrictor having an annular restriction therein adapted for mounting adjacent said evaporator unit and in said air stream, said restrictor being positioned such that frost build-up thereon obstructs said restriction and the flow of air therethrough, said restrictor being supported so the longitudal axis thereof extends horizontally relative to said evaporator unit whereby droplets of liquid resulting from the melting of frost in said restriction flows by gravity in and to the bottom of said annular restriction;

detector means;

a vacuum source;

common conduit means interconnecting said restriction, said detector means, and said vacuum source, said restrictor being provided with a first passage therein, said restriction extending around the periphery of said restrictor and opening into said first passage in said restrictor, said vacuum source and said detector means being connected to said first passage by means of second and third passages respectively, said detector means detecting changes in the vacuum level in said common conduit caused by frost build-up in said restriction obstructing the flow of air therethrough; and control means responsive to said detector means for initiating a defrost cycle when said air pressure in said common conduit reaches a selected value.

2. The frost sensor as defined in claim 1 including wick means extending internally of said restrictor in said first passage for absorbing liquid captured by said restriction.

* * * * *